US006012508A

United States Patent [19]

Folder

[11] Patent Number: 6,012,508

[45] **Date of Patent: *Jan. 11, 2000**

[54] STRIP CASTING

[75] Inventor: William John Folder, Kiama Downs, Australia

[73] Assignees: Ishikawajima-Harima Heavy Indistries Limited, Tokyo, Japan; BHP Steel (JLA) Pty Ltd., Melbourne, Australia

[ * ] Notice: This patent is subject to a terminal disclaimer.

[21] Appl. No.: 08/916,579

[22] Filed: Aug. 22, 1997

[30] Foreign Application Priority Data

Sep. 16, 1996 [AU] Australia ..... 02368

[51] Int. Cl.[7] ..... B22D 11/06; B22D 11/10

[52] U.S. Cl. ..... 164/480; 164/428; 164/607

[58] Field of Search ..... 164/428, 480, 164/437, 488; 222/606, 607

[56] References Cited

U.S. PATENT DOCUMENTS 5,086,957 2/1992 Ozeki et al. ..... 222/606

FOREIGN PATENT DOCUMENTS 61-289953 12/1986 Japan ..... 164/437

64-5650 1/1989 Japan ..... 164/437

1-228649 9/1989 Japan ..... 164/428

*Primary Examiner*—Kuang Y. Lin

*Attorney, Agent, or Firm*—Kerkam, Stowell, Kondracki & Clarke, P.C.; John C. Kerins

[57] ABSTRACT

Metal strip (20) is cast from casting pool (68) of molten metal supported above nip (69) between chilled casting rolls (16). Molten metal is introduced into the casting pool by nozzle (19) having a trough (61) closed by a bottom floor (63). Metal is supplied to trough (61) in free-falling streams (65) which impinge on floor (63) and fan outwardly across the floor and through nozzle side openings (64) into the casting pool. Streams (65) are staggered longitudinally of the trough with respect to the side openings (64).

27 Claims, 6 Drawing Sheets

72
41
43
42
11
32
33
54
53
57
56
82
61
52
16
64
18
31
13

STRIP CASTING

BACKGROUND OF THE INVENTION

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Although twin roll casting has been applied with some success to non-ferrous metals which solidify rapidly on cooling, there have been problems in applying the technique to the casting of ferrous metals which have high solidification temperatures and tend to produce defects caused by uneven solidification at the chilled casting surfaces of the rolls. Much attention has therefore been given to the design of metal delivery nozzles aimed at producing a smooth even flow of metal to and within the casting pool. U.S. Pat. Nos. 5,178,205 and 5,238,050 both disclose arrangements in which the delivery nozzle extends below the surface of the casting pool and incorporates means to reduce the kinetic energy of the molten metal flowing downwardly through the nozzle to a slot outlet at the submerged bottom end of the nozzle. In the arrangement disclosed in U.S. Pat. No. 5,178,205 the kinetic energy is reduced by a flow diffuser having a multiplicity of flow passages and a baffle located above the diffuser. Below the diffuser the molten metal moves slowly and evenly out through the outlet slot into the casting pool with minimum disturbance. In the arrangement disclosed in U.S. Pat. No. 5,238,050 streams of molten metal are allowed to fall so as to impinge on a sloping side wall surface of the nozzle at an acute angle of impingement so that the metal adheres to the side wall surface to form a flowing sheet which is directed into an outlet flow passage. Again the aim is to produce a slowly moving even flow from the bottom of the delivery nozzle so as to produce minimum disruption of the casting pool.

Japanese Patent Publication 5-70537 of Nippon Steel Corporation also discloses a delivery nozzle aimed at producing a slow moving even flow of metal into the casting pool. The nozzle is fitted with a porous baffle/diffuser to remove kinetic energy from the downwardly flowing molten metal which then flows into the casting pool through a series of apertures in the side walls of the nozzle. The apertures are angled in such a way as to direct the in-flowing metal along the casting surfaces of the rolls longitudinally of the nip. More specifically, the apertures on one side of the nozzle direct the in-flowing metal longitudinally of the nip in one direction and the apertures on the other side direct the in-flowing metal in the other longitudinal direction with the intention of creating a smooth even flow along the casting surfaces with minimum disturbance of the pool surface.

After an extensive testing program we have determined that a major cause of defects is premature solidification of molten metal in the regions where the pool surface meets the casting surfaces of the rolls, generally known as the "meniscus" or "meniscus regions" of the pool. The molten metal in each of these regions flows towards the adjacent casting surface and if solidification occurs before the metal has made uniform contact with the roll surface it tends to produce irregular initial heat transfer between the roll and the shell with the resultant formation of surface defects, such as depressions, ripple marks, cold shuts or cracks.

Previous attempts to produce a very even flow of molten metal into the pool have to some extent exacerbated the problem of premature solidification by directing the incoming metal away from the regions at which the metal first solidifies to form the shell surfaces which eventually become the outer surfaces of the resulting strip. Accordingly, the temperature of the metal in the surface region of the casting pool between the rolls is significantly lower than that of the incoming metal. If the temperature of the molten metal at the pool surface in the region of the meniscus becomes too low then cracks and "meniscus marks" (marks on the strip caused by the meniscus freezing while the pool level is uneven) are very likely to occur. One way of dealing with this problem has been to employ a high level of superheat in the incoming metal so that it can cool within the casting pool without reaching solidification temperatures before it reaches the casting surfaces of the rolls.

In recent times it has been recognised that the problem of premature solidification can be addressed more efficiently by taking steps to ensure that the incoming molten metal is delivered relatively quickly by the nozzle directly into the meniscus regions of the casting pool. This minimises the tendency for premature freezing of the metal before it contacts the casting roll surfaces. It has been found that this is a far more effective way to avoid surface defects than to provide absolutely steady flow in the pool and that a certain degree of fluctuation in the pool surface can be tolerated since the metal does not solidify until it contacts the roll surface. Examples of this approach are to be seen in Japanese Patent Publication 64-5650 of Nippon Steel Corporation and our Australian Patent Application 60773/96.

Although the direction of molten metal from the delivery nozzle directly to the meniscus regions of the casting pool allows casting with molten metal supplied with relatively low level of superheat without the formation of surface cracks, problems can arise due to the formation of pieces of solid metal known as "skulls" in the vicinity of the pool confining side plates or dams. These problems are exacerbated as the superheat of the incoming molten metal is reduced. The rate of heat loss from the melt pool is greatest near the side dams due primarily to additional conductive heat transfer through the side dams to the roll ends. This high rate of local heat loss is reflected in the tendency to form "skulls" of solid metal in this region which can grow to a considerable size and fall between the rolls causing defects in the strip. Because the net rate of heat loss is higher near the side dams the rate of heat input to these regions must be increased if skulls are to be prevented. There have been previous proposals to provide an increased flow of metal to these "triple point" regions by providing flow passages in the end of the core nozzle to direct separate flows of metal to the triple point regions. Examples of such proposals may be seen in U.S. Pat. No. 4,694,887 and in U.S. Pat. No. 5,221,511.

Our aforesaid Australian Patent Application 60773/96 discloses a method and apparatus in which molten metal is delivered in one or more free falling streams in the bottom of the core nozzle trough which is closed at the bottom and is provided with side openings through which the molten metal flows from the nozzle into a casting pool in the vicinity of the casting pool surface. In that arrangement the side openings in the nozzle were formed at a height some distance above the floor of the nozzle trough and the system was designed to operate with a substantial head of molten metal within the nozzle trough rising to a level above the side openings and substantially above the level of the casting pool surface outside the trough. Although this arrangement has been operated satisfactorily it has been found that the head of molten metal accumulated within the nozzle trough is susceptible to vertical oscillations generated by the action of the impingement of the falling streams of the molten metal on the surface of the metal within the trough. Moreover, air and other gas becomes entrained in the accumulated head of molten metal and combined with the oscillation effect this has the result that it is very difficult to achieve a steady flow through the side openings and there is significant turbulence within the casting pool. The present invention provides an improved nozzle arrangement which enables a more stable flow of molten metal into the casting pool and accordingly less turbulence within the pool.

SUMMARY OF THE INVENTION

According to the invention there is provided a method of casting metal strip comprising:

introducing molten metal between a pair of chilled casting rolls via an elongate metal delivery nozzle disposed above and extending along the nip between the rolls to form a casting pool of molten metal supported above the nip and confined at the ends of the nip by pool confining end closures, and rotating the rolls so as to cast a solidified strip delivered downwardly from the nip;

wherein the bottom of the nozzle trough is provided with a floor and molten metal is caused to flow from the trough into the casting pool through nozzle side openings formed at the bottom corners of the trough so as to provide for egress of molten metal from the trough at the floor of the trough and molten metal is supplied to the trough in a series of free-falling streams which impinge directly on the trough floor so as to fan outwardly across the trough floor and through the nozzle openings at the nozzle floor level into the casting pool in mutually oppositely directed jet streams.

Preferably, the nozzle side openings extend at their outlet ends below the level of the nozzle floor.

Preferably, the nozzle side openings are in the form of elongate slots extending along the bottom corners of the trough at longitudinally spaced intervals.

Preferably further, the floor of the trough is provided with longitudinally spaced recesses adjacent the side openings so that the side openings are formed as continuations of the recesses in the floor.

The recesses may slope outwardly and downwardly from a central region of the trough floor toward the side outlets along each side of the nozzle.

The invention also provides apparatus for casting metal strip, comprising a pair of parallel casting rolls forming a nip between them, an elongate metal delivery nozzle disposed above and extending along the nip between the casting rolls for delivery of molten metal into the nip and a distributor disposed above the delivery nozzle for supply of molten metal to the delivery nozzle in a series of free-falling streams, wherein the metal delivery nozzle comprises an upwardly opening elongate trough extending longitudinally of the nip to receive molten metal from the distributor, the bottom of the trough is provided with a floor on which to impinge the free-falling streams of molten metal and the delivery nozzle is provided with side openings disposed at the bottom corners of the trough so as to provide for direct egress of the impinging molten metal from the trough at the floor of the trough.

The invention further provides a refractory nozzle for delivery of molten metal to a casting pool of a twin roll caster, said nozzle comprising an elongate open topped trough to receive molten metal which trough is closed by a nozzle floor and wherein the nozzle is provided with side openings disposed at the bottom corners of the trough so as to provide for egress of molten metal from the trough at the floor of the trough.

BRIEF DESCRIPTION OF THE DRAWINGS

In order that the invention may be more fully explained one particular method and apparatus will be described in some detail with reference to the accompanying drawings in which.

DESCRIPTION OF THE PREFERRED EMBODIMENT

Figure 1:
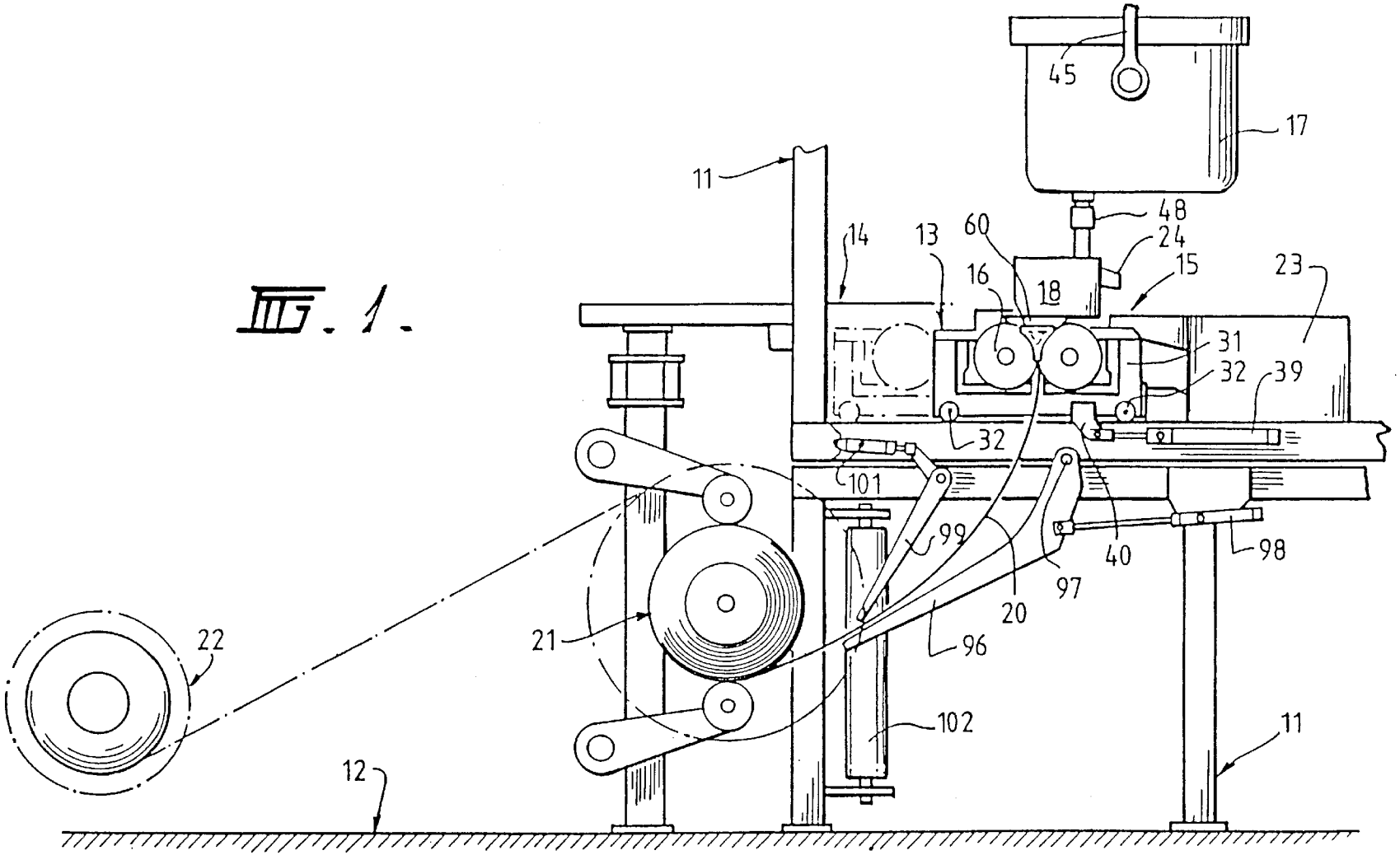
FIG. 1 illustrates a twin-roll continuous strip caster constructed and operating in accordance with the present invention.
Figure 2:
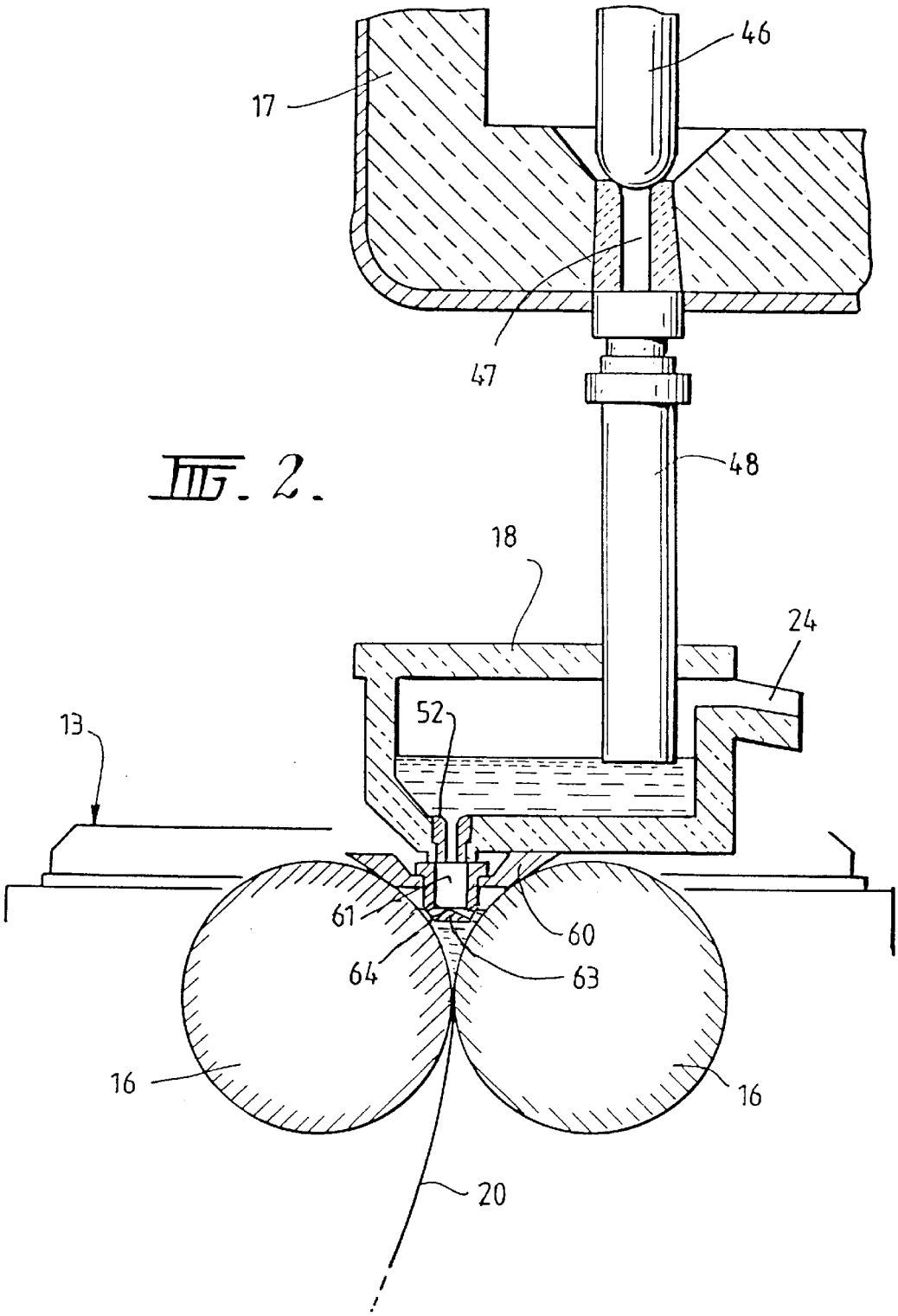
FIG. 2 is a vertical cross-section through important components of the caster illustrated in FIG. 1 including a metal delivery nozzle constructed in accordance with the invention.
Figure 3:
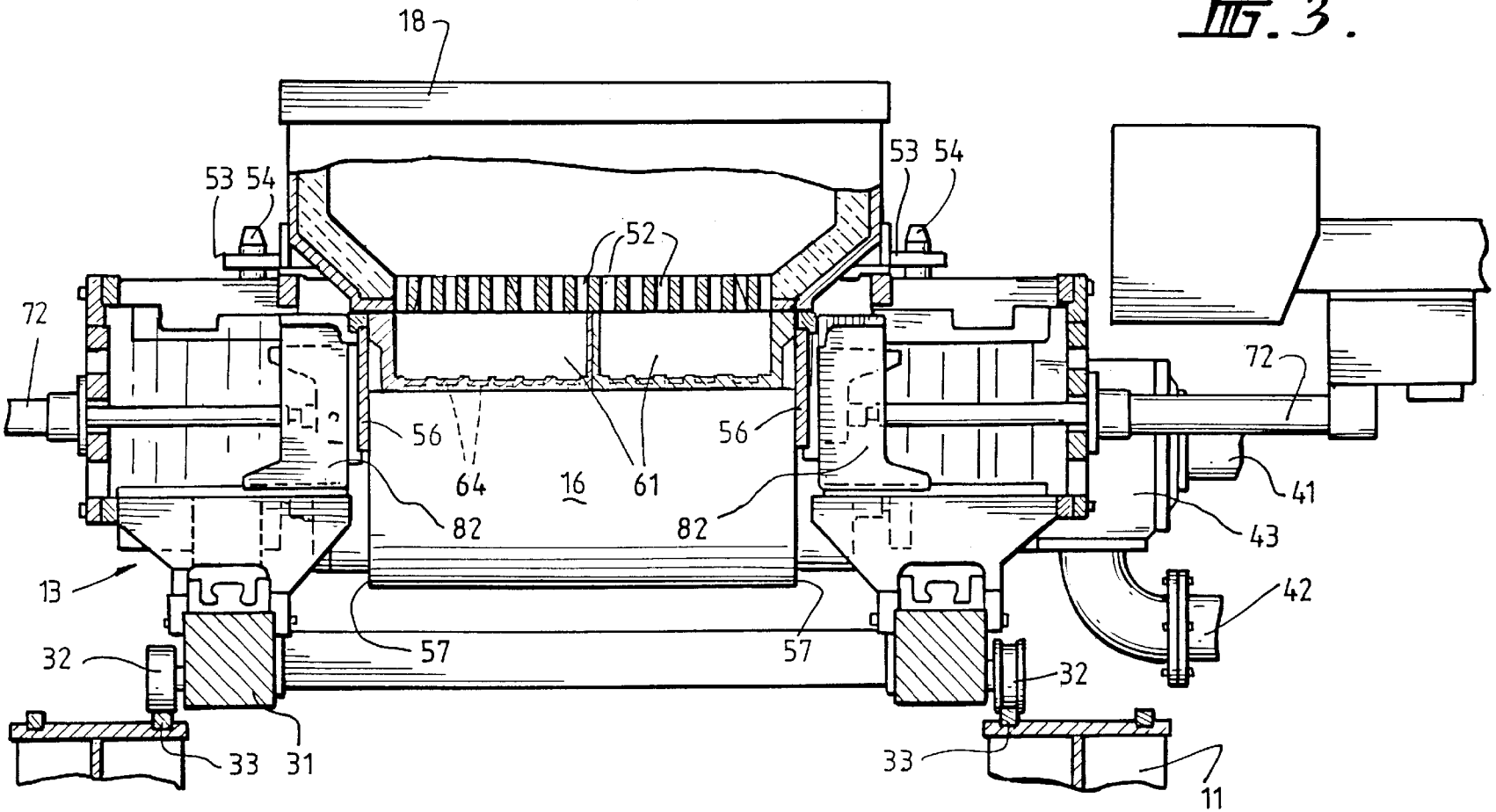
FIG. 3 is a further vertical cross-section through important components of the caster taken transverse to the section of FIG. 2.
Figure 4:
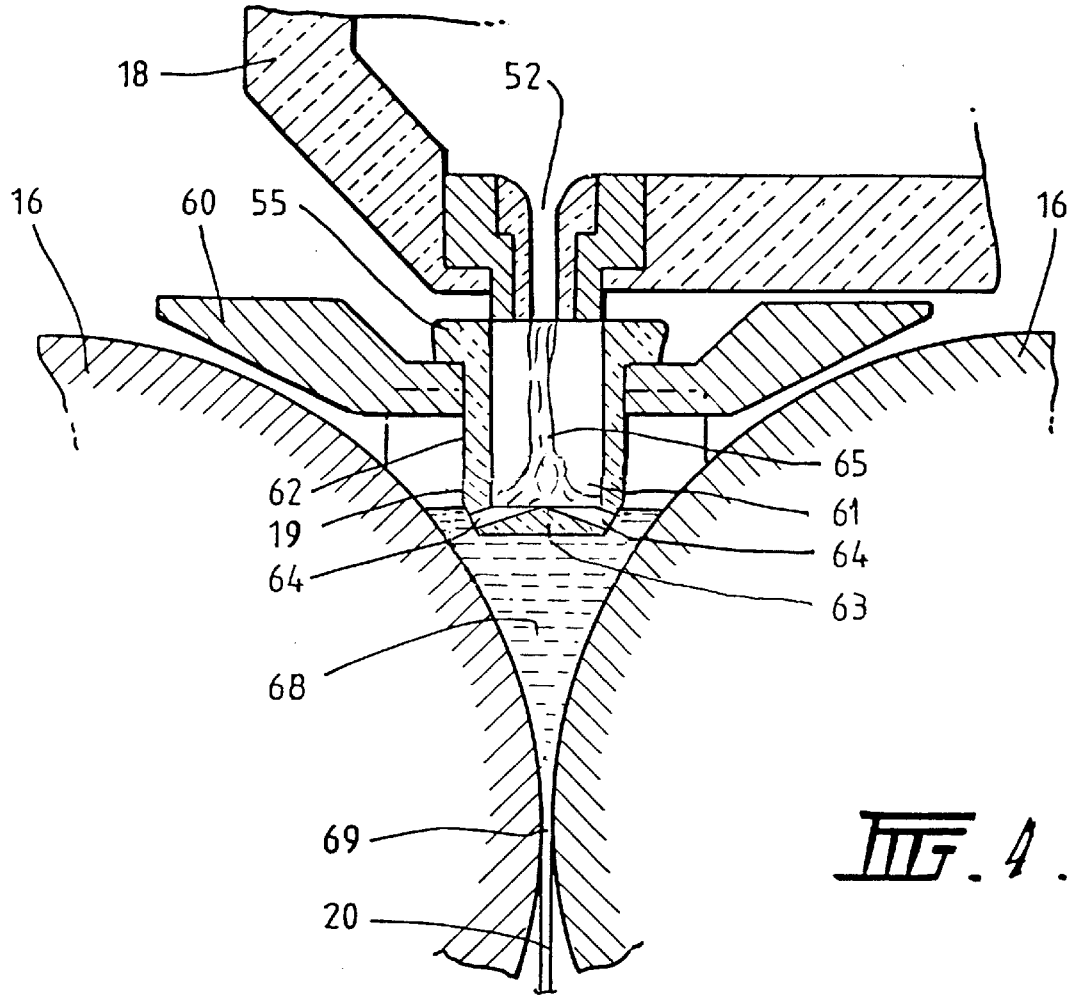
FIG. 4 is an enlarged transverse cross-section through the metal delivery nozzle and adjacent parts of the casting rolls.

The illustrated caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a distributor 18 and delivery nozzle 19. Casting rolls 16 are water cooled so that shells solidify on the moving roll surfaces and are brought together at the nip between them to produce a solidified strip product 20 at the nip outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Carriage 13 is movable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and visa versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 2 m long in order to produce up to 2 m wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is formed as a wide dish made of a refractory material such as high alumina castable with a sacrificial lining. One side of the distributor receives molten metal from the ladle and is provided with the aforesaid overflow 24. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as accurately to locate the distributor.

Figure 5:
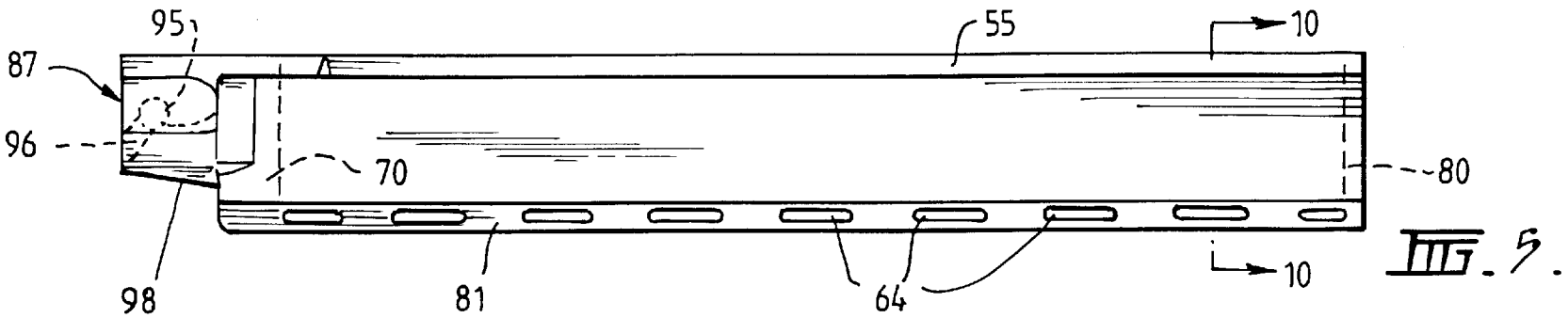
FIG. 5 is a side elevation of a one half segment of the metal delivery nozzle.
Figure 6:
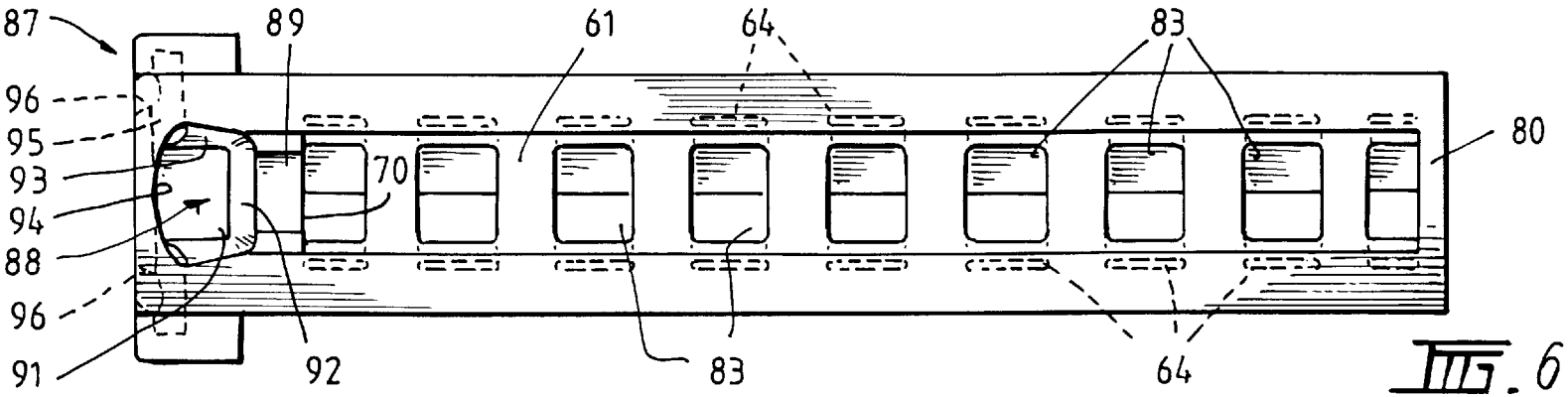
FIG. 6 is a plan view of the nozzle segment shown in FIG. 5.
Figure 7:
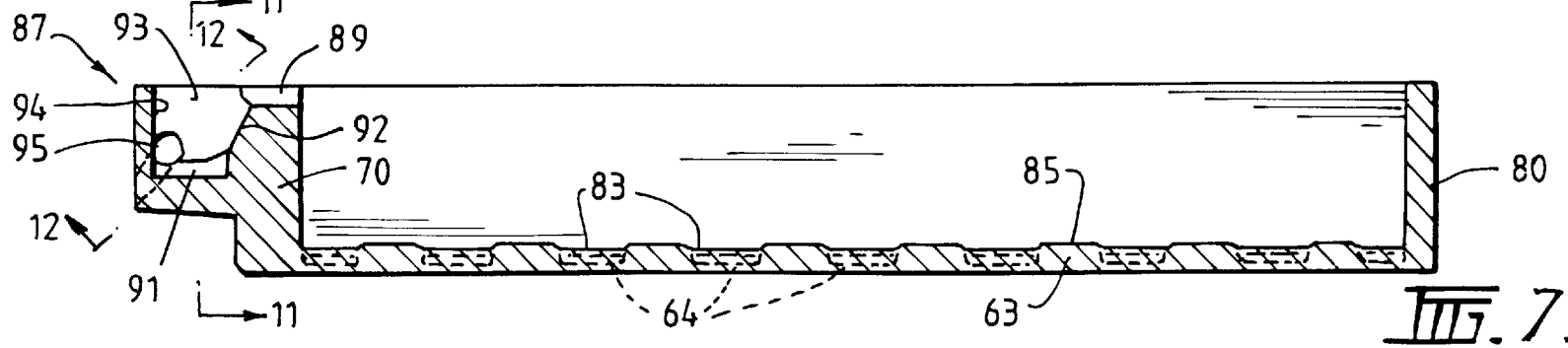
FIG. 7 is a longitudinal cross-section through the delivery nozzle segment.
Figure 8:
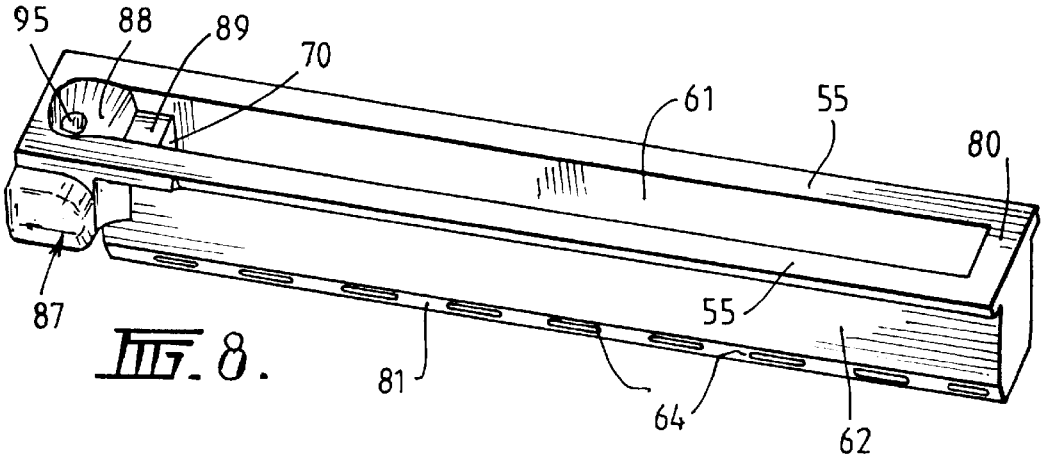
FIG. 8 is a perspective view of the delivery nozzle segment.
Figure 9:
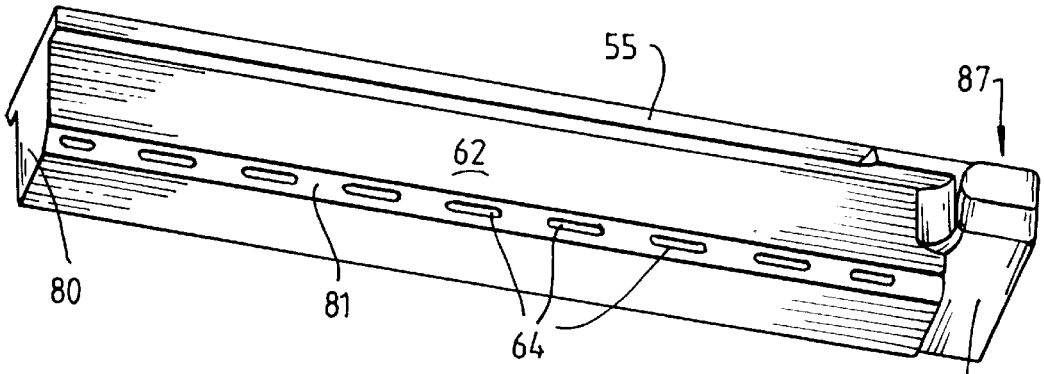
FIG. 9 is an inverted perspective view of the nozzle segment.
Figure 10:
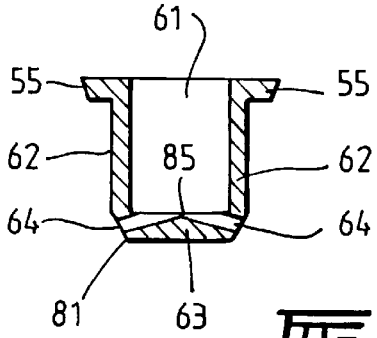
FIG. 10 is a transverse cross-section through the delivery nozzle segment on the line 10—10 in FIG. 5.
Figure 11:
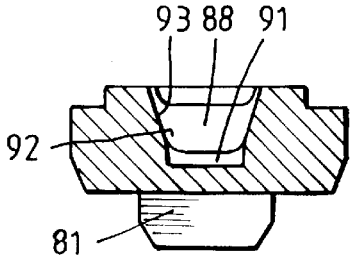
FIG. 11 is a cross-section on the line 11—11 in FIG. 7.
Figure 12:
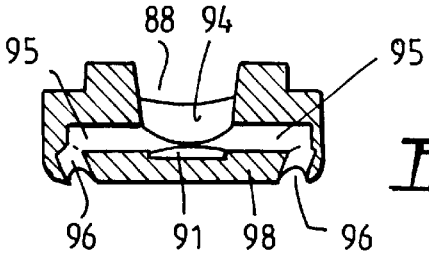
FIG. 12 is a cross-section on the line 12—12 in FIG. 7.

Delivery nozzle 19 is formed in two identical half segments which are made of a refractory material such as alumina graphite are held end to end to form the complete nozzle. FIGS. 5 to 11 illustrate the construction of the nozzle segments which are supported on the roll carriage frame by a mounting bracket 60, the upper parts of the nozzle segments being formed with outwardly projecting side flanges 55 which locate on that mounting bracket.

Each nozzle half segment is of generally trough formation so that the nozzle 19 defines an upwardly opening inlet trough 61 to receive molten metal flowing downwardly from the openings 52 of the distributor. Trough 61 is formed between nozzle side walls 62 and end walls 70 and may be considered to be transversely partitioned between its ends by the two flat end walls 80 of the nozzle segments which are brought together in the completed nozzle. The bottom of the trough is closed by a horizontal bottom floor 63 which meets the trough side walls 62 at chamfered bottom corners 81. The nozzle is provided at these bottom corners with a series of side openings in the form of longitudinally spaced elongate slots 64 arranged at regular longitudinal spacing along the nozzle. Slots 64 are positioned to provide for egress of molten metal from the trough at the level of the trough floor 63. The trough floor is provided adjacent the slots with recesses 83 which slope outwardly and downwardly from the centre of the floor toward the slots and the slots continue as extensions of the recesses 83 to slot outlets 84 disposed in the chamfered bottom corners 81 of the nozzle beneath the level of the upper floor surface 85.

The outer ends of the nozzle segments are provided with triple point pouring end formations denoted generally as 87 extending outwardly beyond the nozzle end wall 70. Each end wall formation 87 defines a small open topped reservoir 88 to receive molten metal from the distributor, this reservoir being separated from the main trough of the nozzle by the end wall 70. The upper end 89 of end wall 70 is lower than the upper edges of the trough and the outer parts of the reservoir 88 and can serve as a weir to allow back flow of molten metal into the main nozzle trough from the reservoir 88 if the reservoir is over filled, as will be more fully explained below.

Reservoir 88 is shaped as a shallow dish having a flat floor 91, inclined inner and side faces 92, 93 and a curved upright outer face 94. A pair of triple point pouring passages 95 extend laterally outwardly from this reservoir just above the level of the floor 91 to connect with triple point pouring outlets 96 in the undersides of the nozzle end formations 87, the outlets 96 being angled downwardly and inwardly to deliver molten metal into the triple point regions of the casting pool.

Molten metal falls from the outlet openings 52 of the distributor in a series of free-falling vertical streams 65 into the bottom part of the nozzle trough 61. Molten metal flows from this reservoir out through the side openings 64 to form a casting pool 68 supported above the nip 69 between the casting rolls 16. The casting pool is confined at the ends of rolls 16 by a pair of side closure plates 56 which are held against the ends 57 of the rolls. Side closure plates 56 are made of strong refractory material, for example boron nitride. They are mounted in plate holders 82 which are movable by actuation of a pair of hydraulic cylinder units 83 to bring the side plates into engagement with the ends of the casting rolls to form end closures for the casting pool of molten metal.

In the casting operation the flow of metal is controlled to maintain the casting pool at a level such that the lower end of the delivery nozzle 19 is submerged in the casting pool and the two series of horizontally spaced side openings 64 of the delivery nozzle are disposed immediately beneath the surface of the casting pool. The molten metal flows through the openings 64 in two laterally outwardly directed jet streams in the general vicinity of the casting pool surface so as to impinge on the cooling surfaces of the rolls in the immediate vicinity of the pool surface. This maximises the temperature of the molten metal delivered to the meniscus regions of the pool and it has been found that this significantly reduces the formation of cracks and meniscus marks on the melting strip surface.

In accordance with the present invention the molten metal is caused to flow from the extreme bottom part of the nozzle trough 61 through the nozzle side openings 64 generally at the level of the floor of the trough. The metal enters the casting pool in mutually oppositely directed jet streams immediately below the surface of the pool to impinge on the casting roll surfaces in the meniscus regions of the pool. The outlet slots 64 are sized to provide a flow rate which allows the metal to flow directly into the pool without accumulating any substantial head of metal within the nozzle trough. Accordingly the falling molten metal streams 65 impinge directly onto the upper surface 85 of the nozzle floor 63 to fan outwardly across the floor and across the floor recesses 83 into the slot outlets 64. To enhance this conversion of kinetic energy to outward fanning movement of the metal the outlet openings 52 of the distributor are staggered longitudinally of the nozzle with respect to the nozzle side openings 64 so that the falling streams 65 impinge on the nozzle floor at locations between successive pairs of side openings 64. Accordingly they impinge on the flat regions of the floor 97 disposed between the recesses 83. It has been found that the system can be operated to establish a casting pool which rises to a level only just above the bottom of the delivery nozzle so that the casting pool surface is only just above the floor of the nozzle trough and at the same level as the metal within the trough. Under these conditions it is possible to obtain very stable pool conditions and if the outlet slots are angled downwardly to a sufficient degree it is possible to obtain a quiescent pool surface. By varying the outward and downward inclination of the side openings along the length of the nozzle it is possible to create quiescent regions at which the pool level can be monitored by cameras or other sensors while other parts of the pool are more turbulent to enhance heat transfer at the meniscus regions.

It is also possible by varying the inclination of the nozzle side outlets to produce more turbulence in the central regions of the nozzle compared with regions at the two ends of the nozzle which has the effect of driving slag on the pool surface to the ends of the pool so that it deposits preferentially at the edges of the strip which will be trimmed off in a subsequent side trimming operation. For this purpose the outward and downward inclination of the side openings may vary progressively from shallow angles in the central region of the nozzle to steeper angles toward the ends of the nozzle. This arrangement is most suitable for use with nozzles provided with triple point pouring end formations since the triple point pouring keeps slag away from the side dam plates.

It is important to note that nozzle side slots 64 are provided at the inner ends of the two nozzle sections. This ensures adequate delivery of molten metal to the pool in the vicinity of the central partition in the nozzle and avoids the formation of skulls in this region of the pool.

The triple point pouring reservoirs 88 receive molten metal from the two outermost streams 65 falling from the distributor 18. The alignment of the two outermost holes 52 in the distributor is such that each reservoir 88 receives a single stream impinging on the flat floor 91 immediately outside the sloping side face 92. The impingement of the molten metal on floor 91 causes the metal to fan outwardly across the floor and outwardly through the triple point pouring passages 95 to the outlets 96 which produce downwardly and inwardly inclined jets of hot metal directed across the faces of the side dams and along the edges of the casting rolls toward the nip. Triple point pouring proceeds with only a shallow and wide pool of molten metal within each of the troughs 88, the height of this pool being limited by the height of the upper end 89 of the wall 70. When reservoir 88 is filled molten metal can flow back over the wall end 89 into the main nozzle trough so that the wall end serves as a weir to control the depth of the metal pool in the triple point pouring supply reservoir 88. The depth of the pool is more than sufficient to supply the triple point pouring passages so as to maintain flow at a constant head whereby to achieve a very even flow of hot metal through the triple point pouring passages. This control flow is most important to proper formation of the edge parts of the strip. Excessive flow through the triple point passages can lead to bulging in the edges of the strip whereas to little flow will produce skulls and "snake egg" defects in the strip.

The undersides 98 of the triple point pouring formations 87 are raised above the surface of the casting pool so as to avoid cooling of the pool surface at the triple point region. Moreover, the undersides 98 are outwardly and upwardly inclined. This is desirable in order to prevent an accumulation of slag or other contaminants from jamming beneath the ends of the nozzle. Such jamming can result in blockage of gas and fumes escaping from the casting pool and the risk of explosion.

The illustrated apparatus has been advanced by way of example only and the invention is not limited to the structural details of that apparatus. In particular, it is not essential to the present invention that the delivery nozzle be provided with triple point pouring end formations and it would be possible to provide for the flow of metal to the triple point regions of the pool through simple end openings in the nozzle in the manner described in Australian Patent Application 60773/96. The nozzle need not of course be formed in multiple segments and it would be possible to form a nozzle as a single refractory body. It is to be understood that these and many other variations may be made without departing from the scope of the appended claims.

I claim:

1. A method of casting metal strip comprising:

introducing molten metal between a pair of chilled casting rolls via an elongate metal delivery nozzle disposed above and extending along the nip between the rolls to form a casting pool of molten metal supported above the nip and confined at the ends of the nip by pool confining end closures, and rotating the rolls so as to cast a solidified strip delivered downwardly from the nip;

wherein the bottom of the nozzle trough is provided with a floor and molten metal is caused to flow from the trough into the casting pool through nozzle side openings formed at the bottom corners of the trough and wherein the method comprises introducing the molten metal into the trough in a series of free-falling streams impinging directly on the trough floor whereby to cause molten metal of said streams to fan outwardly across the trough floor and through the nozzle openings at the nozzle floor level into the casting pool in mutually oppositely directed jet streams.

2. A method as claimed in claim 1, wherein the nozzle side openings extend at their outlet ends below the level of the nozzle floor.

3. A method as claimed in claim 1, wherein the nozzle side openings are in the form of elongate slots extending along the bottom corners of the trough at longitudinally spaced intervals.

4. A method as claimed in claim 3, wherein said free-falling streams of molten metal are spaced along the trough so as to be staggered longitudinally of the trough with respect to the nozzle side openings so as to impinge on the nozzle floor at locations between successive pairs of side openings.

5. A method as claimed in claim 1, wherein the floor of the trough is provided with longitudinally spaced recesses adjacent the side openings so that the side openings are formed as continuations of the recesses in the floor.

6. A method as claimed in claim 5, wherein the recesses slope outwardly and downwardly from a central region of the trough floor toward the side outlets along each side of the nozzle.

7. A method as claimed in claim 5, wherein the trough floor is flat between said longitudinally spaced recesses and said free-falling streams of molten metal impinge on the flat parts of the floor between the recesses.

8. A method as claimed in claim 1, wherein the side openings are inclined outwardly and downwardly of the bottom corners of the trough.

9. A method as claimed in claim 8, wherein the outward and downward inclination of the side openings varies along the length of the nozzle.

10. A method as claimed in claim 9, wherein the outward and downward inclination of the side openings varies progressively from relatively shallow angles in the central region of the nozzle to steeper angles toward the ends of the nozzle.

11. Apparatus for casting metal strip, comprising a pair of parallel casting rolls forming a nip between them, an elongate metal delivery nozzle disposed above and extending along the nip between the casting rolls for delivery of molten metal into the nip and a distributor disposed above the delivery nozzle for supply of molten metal to the delivery nozzle in a series of free-falling streams, wherein the metal delivery nozzle comprises an upwardly opening elongate trough extending longitudinally of the nip to receive molten metal from the distributor, the bottom of the trough is provided with a floor on which to impinge the free-falling streams of molten metal and the delivery nozzle is provided with side openings disposed at the bottom corners of the trough so as to provide for direct egress of the impinging molten metal from the trough at the floor of the trough.

12. Apparatus as claimed in claim 11, wherein the nozzle side openings extend at their outlet ends below the level of the nozzle floor.

13. Apparatus as claimed in claim 11, wherein the nozzle side openings are in the form of elongate slots extending along the bottom corners of the trough at longitudinally spaced intervals.

14. Apparatus as claimed in claim 11, wherein the distributor is formed to deliver said free-falling streams of molten metal at spaced locations along the trough so as to be staggered longitudinally of the trough with respect to the nozzle side openings.

15. Apparatus as claimed in claim 11, wherein the floor of the trough is provided with longitudinally spaced recesses adjacent the side openings so that the side openings are formed as continuations of the recesses in the floor.

16. Apparatus as claimed in claim 15, wherein the recesses slope outwardly and downwardly from a central region of the trough floor toward the side outlets along each side of the nozzle.

17. Apparatus as claimed in claim 15, wherein the nozzle floor is flat between said longitudinally spaced recesses.

18. Apparatus as claimed in claim 11, wherein the side openings are inclined outwardly and downwardly of the bottom corners of the trough.

19. Apparatus as claimed in claim 18, wherein the outward and downward inclination of the side openings varies along the length of the nozzle.

20. Apparatus as claimed in claim 19, wherein the outward and downward inclination of the side openings varies progressively from relatively shallow angles in the central region of the nozzle to steeper angles toward the ends of the nozzle.

21. A refractory nozzle for delivery of molten metal to a casting pool of a twin roll caster, said nozzle comprising an elongate open topped trough to receive molten metal which trough is closed by a nozzle floor and wherein the nozzle is provided with side openings disposed at the bottom corners of the trough so as to provide for egress of molten metal from the trough at the floor of the trough, and wherein the floor of the trough is provided with longitudinally spaced recesses adjacent the side openings so that the side openings are formed as continuations of the recesses in the floor.

22. A refractory nozzle as claimed in claim 21, wherein the nozzle side openings extend at their outlet ends below the level of the nozzle floor.

23. A refractory nozzle as claimed in claim 21, wherein the nozzle side openings are in the form of elongate slots extending along the bottom corners of the trough at longitudinally spaced intervals.

24. A refractory nozzle as claimed in claim 21, wherein the recesses slope outwardly and downwardly from a central region of the trough floor toward the side outlets along each side of the nozzle.

25. A refractory nozzle as claimed in claim 21, wherein the side openings are inclined outwardly and downwardly of the bottom corners of the trough.

26. A refractory nozzle as claimed in claim 25, wherein the outward and downward inclination of the side openings varies along the length of the nozzle.

27. A refractory nozzle as claimed in claim 26, wherein the outward and downward inclination of the side openings varies progressively from relatively shallow angles in the central region of the nozzle to steeper angles toward the ends of the nozzle.

* * * * *